US011435042B1

(12) United States Patent
Yang

(10) Patent No.: US 11,435,042 B1
(45) Date of Patent: Sep. 6, 2022

(54) PROJECTION DEVICE

(71) Applicant: SHENZHEN QIAOHUA INDUSTRIES LIMITED, Shenzhen (CN)

(72) Inventor: Ruishi Yang, Shenzhen (CN)

(73) Assignee: SHENZHEN QIAOHUA INDUSTRIES LIMITED, Shenzhen (CN)

( * ) Notice: Subject to any disclaimer, the term of this patent is extended or adjusted under 35 U.S.C. 154(b) by 0 days.

(21) Appl. No.: 17/712,033

(22) Filed: Apr. 1, 2022

(30) Foreign Application Priority Data

Sep. 10, 2021 (CN) ..... 202122187911.8

(51) Int. Cl.
*F21S 10/00* (2006.01)
*F21V 7/05* (2006.01)

(52) U.S. Cl.
CPC ..... *F21S 10/007* (2013.01); *F21V 7/05* (2013.01)

(58) Field of Classification Search
CPC ..... F21S 10/007; F21V 7/05; Y10S 362/806; Y10S 362/807
USPC ..... 362/806, 807, 292, 277
See application file for complete search history.

(56) References Cited

U.S. PATENT DOCUMENTS 5,324,224 A * 6/1994 Anderson ..... A63H 33/26 362/184
2007/0211475 A1* 9/2007 Sevack ..... F21S 8/02 362/351
2012/0162993 A1* 6/2012 Cheng ..... F21V 29/767 362/284
2014/0226336 A1* 8/2014 Chi ..... F21K 9/65 362/280
2021/0164628 A1* 6/2021 Zheng ..... F21V 14/02

* cited by examiner

*Primary Examiner* — Laura K Tso

(57) ABSTRACT

A projection device includes a light beam generator including an incoherent light source assembly, a reflecting mirror arranged on one side of the light beam generator, an interference structure arranged on a reflecting light path of the reflecting mirror and generating a pattern effect, a first gear structure arranged on an outer side of the interference structure, a convex lens arranged on an exit light path of the interference structure; and a motor. A light beam generated by the light beam generator irradiates on one surface of the reflecting mirror along an incident light path of the reflecting mirror and reflects to a side surface of the interference structure. The light beam passes through the interference structure and the convex lens in sequence to form a patterned projection. A second gear structure engaged with the first gear structure is arranged on an output shaft of the motor.

4 Claims, 5 Drawing Sheets

PROJECTION DEVICE

TECHNICAL FIELD

The present disclosure relates to a field of projection equipment technology, and in particular to a projection device.

BACKGROUND

A projection device is configured for indoor projection or outdoor projection. For example, the projection device is applied in homes, offices, planetariums, etc. The projection device with patterns or star fields can create a starry sky effect.

For example, Chinese Patent CN 101276523 B discloses a starry sky projection device, which comprises at least one incoherent light source, at least a pair of convex lenses, an inner convex lens, an outer convex lens, at least one interference filter disc and a motor connected to the interference filter disc. The interference filter disc is arranged between the incoherent light source and the inner convex lens, and the interference filter disc is arranged between the inner convex lens and the outer convex lens. When the motor drives the interference filter disc to rotate, the interference filter disc forms a cloud-like effect. The starry sky projection device further comprises at least one diffractive optical element, at least one coherent light source, a grating disc. The motor is connected to the grating disc. The diffractive optical element is arranged between the grating disc and the coherent light source. Driven by the motor, the above-mentioned structures are arranged to form a movable starry sky effect.

However, the interference filter disc is connected to an output shaft of the motor, and an inner convex lens and the outer convex lens are separately arranged on a front side and a rear side of the interference filter disc, which leads to a relatively low utilization rate of the grating disc, so a structure of the starry sky projection device is not compact.

Therefore, it is necessary to improve the projection device in the prior art.

SUMMARY

The present disclosure provides a projection device to solve defects in the prior art.

In order to achieve the above object, the present disclosure provides a projection device. The projection device comprises a light beam generator, a reflecting mirror arranged on one side of the light beam generator, an interference structure configured to generate a pattern effect, a first gear structure arranged on an outer side of the interference structure, a convex lens arranged on an exit light path of the interference structure, and a motor.

The light beam generator comprises an incoherent light source assembly. A first light beam generated by the light beam generator irradiates on a surface of the reflecting mirror along an incident light path of the reflecting mirror. The interference structure is arranged on a reflecting light path of the reflecting mirror. The first light beam reflects to a side surface of the interference structure after irradiating on the surface of the reflecting mirror. The light beam passes through the interference structure and the convex lens in sequence to form a patterned projection. A second gear structure engaged with the first gear structure is arranged on an output shaft of the motor. The first gear structure and the second gear structure rotate to make the interference structure to rotate.

Optionally, the projection device further comprises a coherent light source assembly and a grating sheet. The coherent light source assembly provides a coherent light source. The grating sheet is arranged on an exit light path of the coherent light source assembly. A second light beam emitted by the coherent light source assembly passes through the grating sheet to form light spots. The light spots are star-shaped.

Optionally, the light beam generator further comprises a condenser cup. Light emitted by the incoherent light source assembly passes through the condenser cup to form the first light beam of the light beam generator.

Optionally, a central axis of the light beam generator is perpendicular to a central axis of the interference structure. The central axis of the light beam generator is 45 degrees with a normal of the reflecting mirror. The first light beam is totally reflected by the reflecting mirror onto the interference structure, then the first light beam sequentially passes through the interference structure and the convex lens to form the patterned projection.

Compared with the prior art, in the preset disclosure, by adding the reflecting mirror, a connection mode and a positional relationship between the reflecting motor and the interference structure are changed, which improves an utilization rate of the interference structure and makes a structure of the projection device compact.

BRIEF DESCRIPTION OF DRAWINGS

In order to clearly describe technical solutions in the embodiments of the present disclosure, the following will briefly introduce the drawings that need to be used in the description of the embodiments or the prior art. Apparently, the drawings in the following description are merely some of the embodiments of the present disclosure, and those skilled in the art are able to obtain other drawings according to the drawings without contributing any inventive labor. In the drawing.

In the drawings.

1—light beam generator; 101—incoherent light source assembly; 102—condenser cup; 103—fixing tube; 2—mounting frame; 21—first mounting post; 22—reflecting mirror mounting groove; 221—first angle adjusting structure 222—second angle adjusting structure; 223—limit structure; 224—second mounting post; 23—first fastening structure; 24—second fastening structure; 3—interference structure; 4—first gear structure; 5—gear pressing sheet; 6—gear cover; 7—refelecting mirror; 8—motor; 9—second gear structure; 10—heat dissipating device; 11—Grating sheet; 12—Circuit board; 13—housing; 131—pattern projection window; 132—star projection window; 133—third fastening structure; 14—dust-proof structure; 15—lens pressing sheet; 16—convex lens.

The realization of the purpose, functional characteristics, and advantages of the present disclosure will be further described in conjunction with the embodiments and with reference to the accompanying drawings.

DETAILED DESCRIPTION

The following will clearly and completely describe technical solutions in the embodiments of the present disclosure with reference to accompanying drawings in the embodiments of the present disclosure. Obviously, the described embodiments are only a part of the embodiments of the present disclosure, rather than all of the embodiments. Based on the embodiments of the present disclosure, all other embodiments obtained by those of ordinary skill in the art without creative work shall fall within the protection scope of the present disclosure.

It should be noted that all the directional indications (such as up, down, left, right, front, back . . . ) in the embodiments of the present disclosure are only used to explain relative positional relationship, movement, etc. of various components in a certain posture (as shown in the figures). If the certain posture changes, the directional indication also change accordingly.

In addition, terms such as "first" and "second" are only used for the purpose of description, rather than being understood to indicate or imply relative importance or hint the number of indicated technical features. Thus, the feature limited by "first" and "second" can explicitly or impliedly include one or more features.

In addition, technical solutions of various embodiments can be combined with each other, only if they are based on what can be achieved by those ordinary skilled in the art. When the combination of technical solutions is contradictory or unable to be achieved, it should be considered that such a combination of technical solutions does not exist and is not within the protection scope of the present disclosure.

Figure 1:
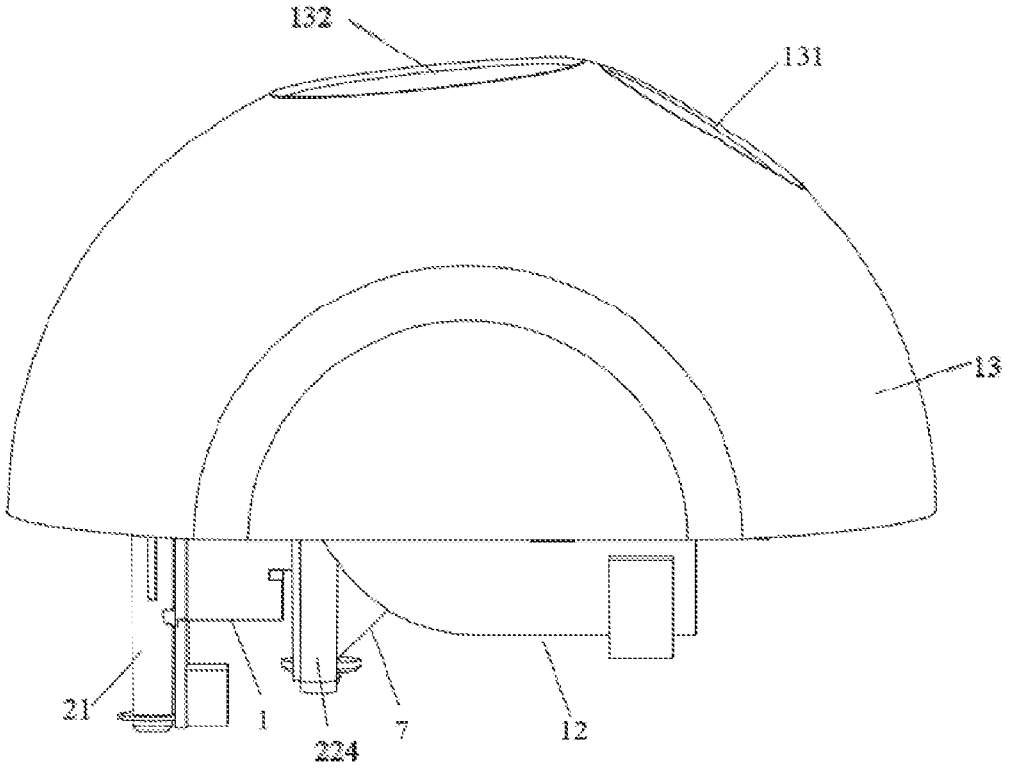
FIG. 1 is a schematic diagram showing a structure of a projection device according to one embodiment of the present disclosure.
Figure 2:
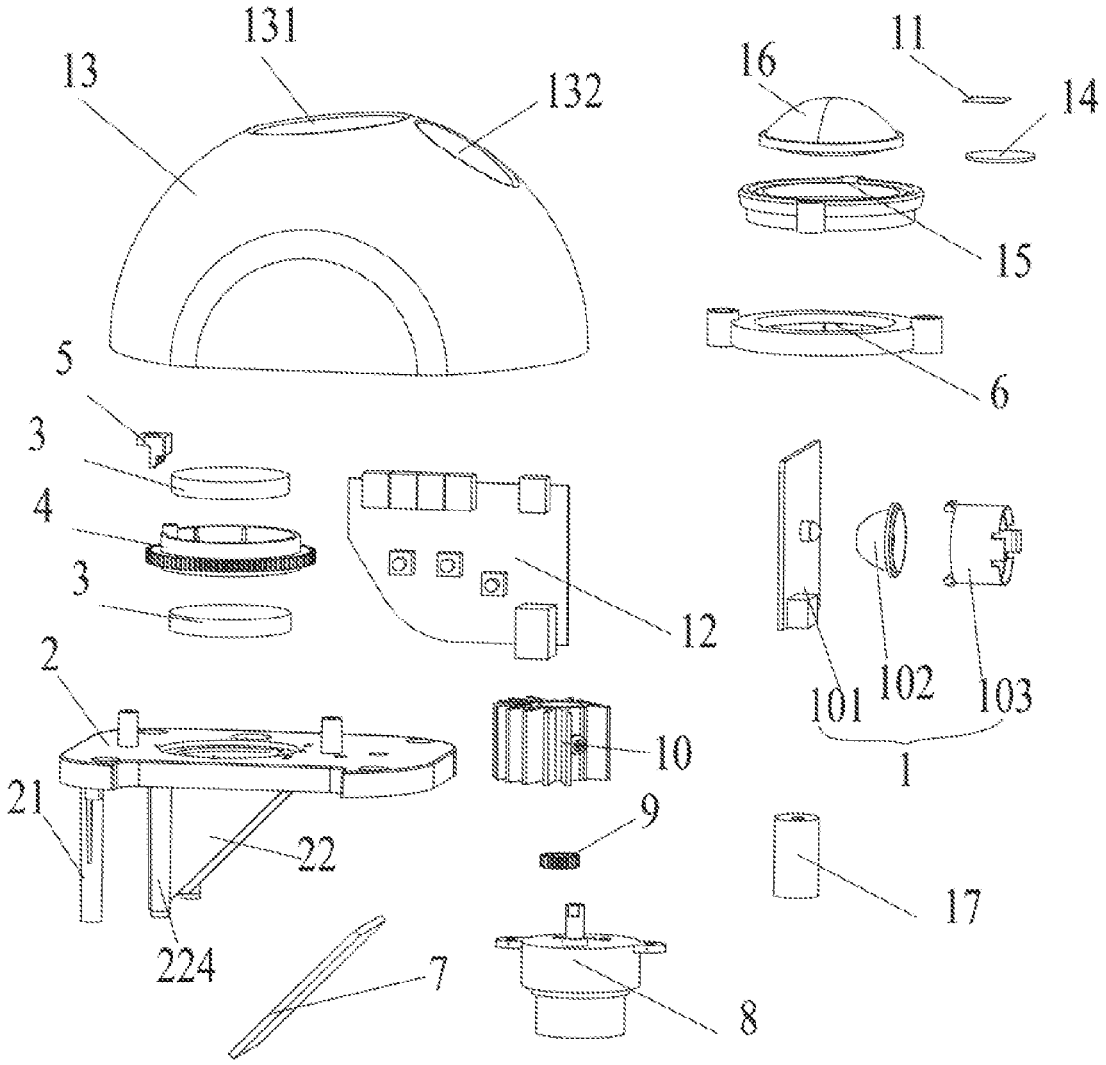
FIG. 2 is an exploded view of the projection device according to one embodiment of the present disclosure.
Figure 3:
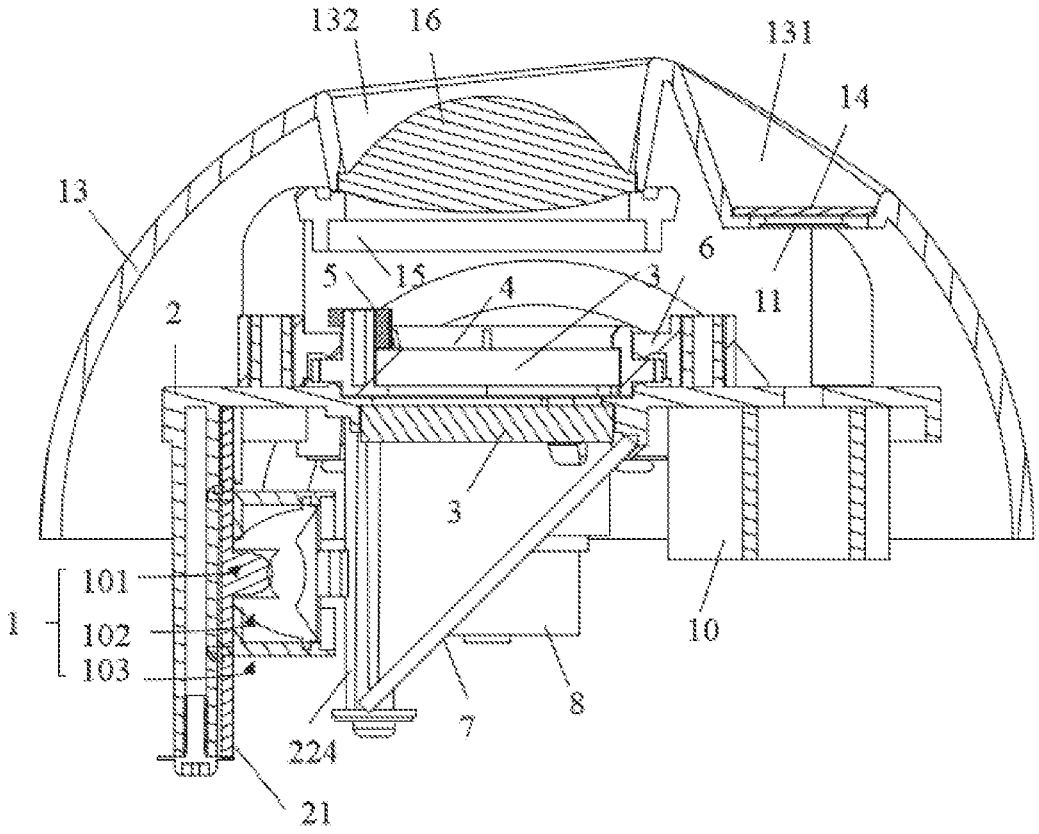
FIG. 3 is a cross-sectional view of the projection device according to one embodiment of the present disclosure.
Figure 4:
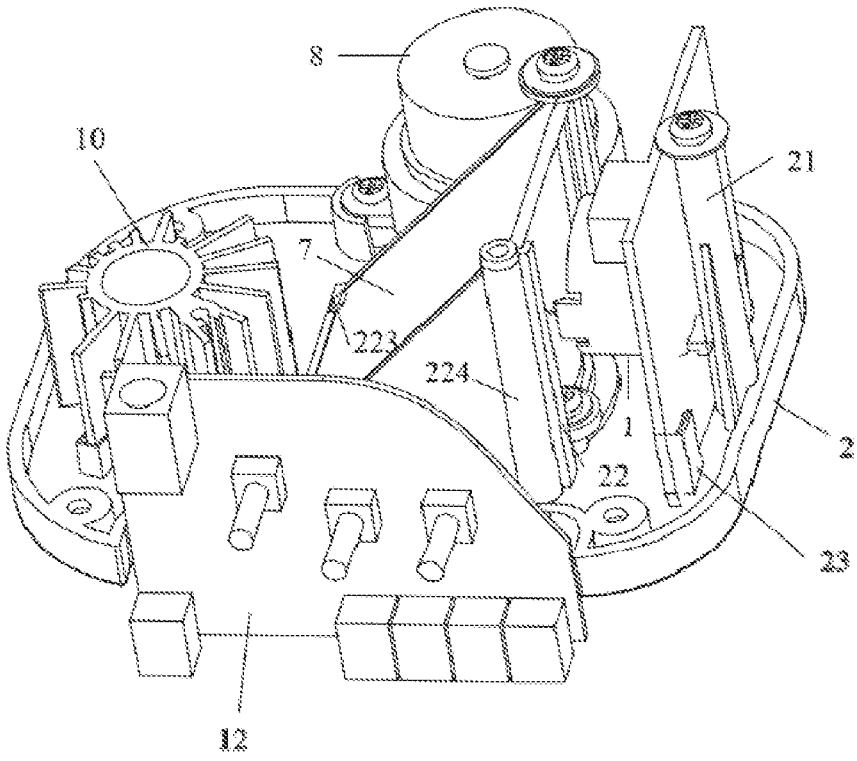
FIG. 4 is a schematic diagram showing some internal structures of the projection device according to one embodiment of the present disclosure.
Figure 5:
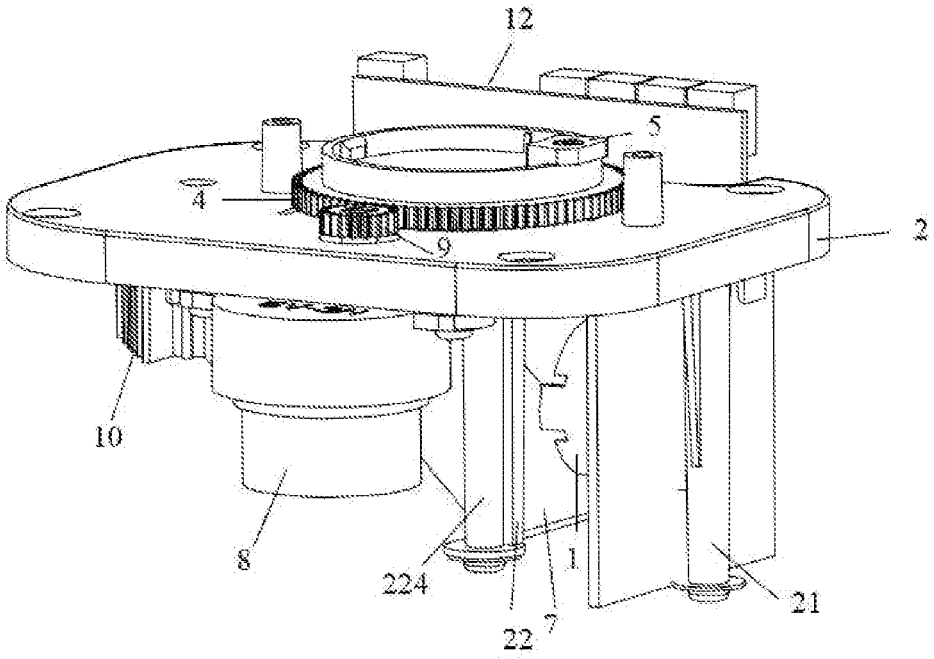
FIG. 5 is a schematic diagram showing some internal structures of the projection device according to one embodiment of the present disclosure.
Figure 6:
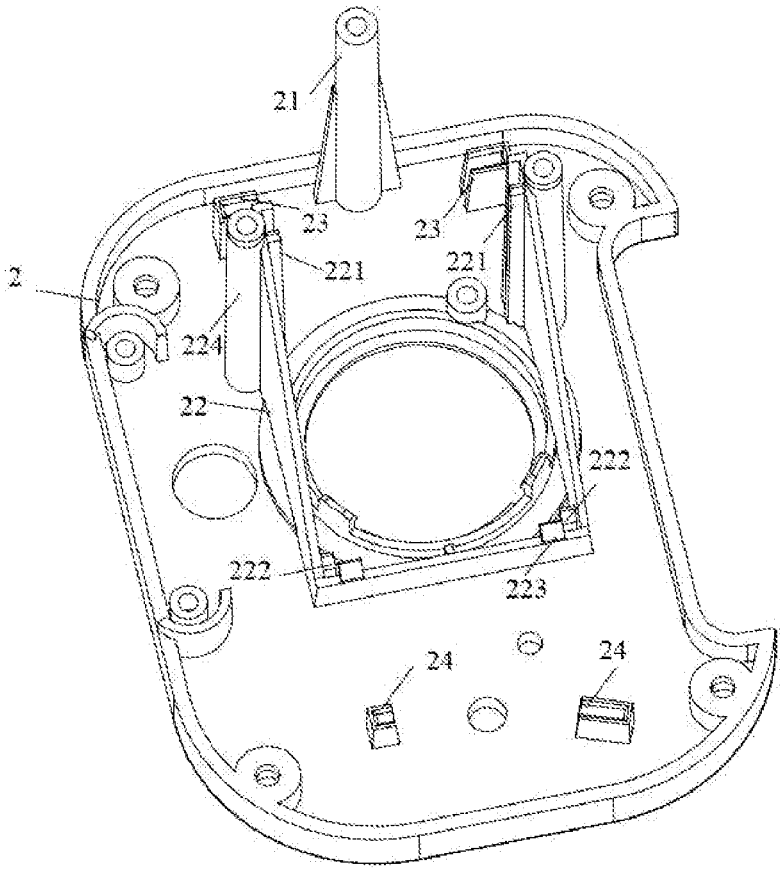
FIG. 6 is a schematic diagram showing a structure of a first mounting frame of the projection device according to one embodiment of the present disclosure.
Figure 7:
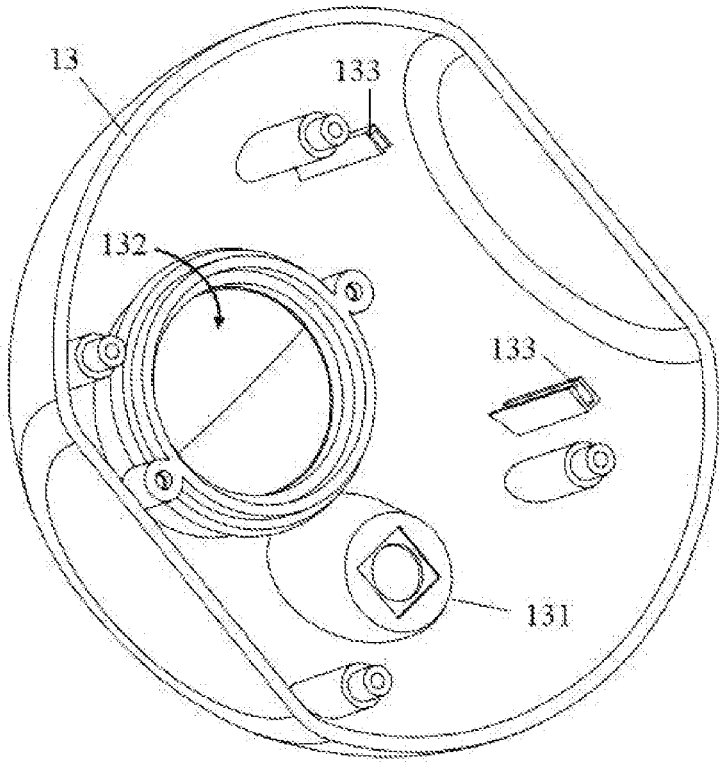
FIG. 7 is a schematic diagram showing a structure of a housing of the projection device according to one embodiment of the present disclosure.

In one embodiment of the present disclosure, as shown in FIGS. 1-7, the present disclosure provides a projection device. The projection device comprises a housing 13 and a projection assembly. The housing 13 comprises a pattern projection window 131 and a star projection window 132. The projection assembly comprises a mounting frame 2. One end of the mounting frame 2 is connected with a light beam generator 1. The light beam generator 1 comprises an incoherent light source assembly 101, a condenser cup 102, and a fixing tube 103 configured to fix the condenser cup 102. Light emitted by the incoherent light source assembly 101 forms a first light beam after passing through the condenser cup 102. The incoherent light source assembly 101 comprises a circuit board structure and an incoherent light source device arranged on the circuit board structure, such as an LED lamp, a broadband light source, and a super luminescent diode. The incoherent light source device is configured to generate incoherent light sources. A first mounting post 21 and a first fastening structure 23 are arranged on one end of the mounting frame 2. A first threaded hole is on one end of the first mounting post 21 away from the mounting frame 2.

The first fastening structure 23 is close to an inner side of the mounting frame 2. A fixing method of the light beam generator 1 is as follow: the circuit board structure is clamped into the first fastening structure 23, a crew is clamped into the first threaded hole. After the screw is tightened, the circuit board structure is clamped on and connected to the screw. The light beam generator 1 is fixed by the first mounting post 21, the first fastening structure 23, and the screw. The fixing method of which is simple and convenient for maintenance.

The projection device further comprises a reflecting mirror 7. The reflecting mirror 7 is arranged on one side of the light beam generator 1. The first light beam generated by the light beam generator 1 irradiates on one surface of the reflecting mirror 7 along an incident light path of the reflecting mirror 7. In order to fix the reflecting mirror 7 and to adjust an inclination angle of the reflecting mirror 7, a reflecting mirror mounting groove 22 is arranged on one side of the mounting frame 2. The reflecting mirror mounting groove 22 and the light beam generator 1 are arranged on a same side of the mounting frame 2. First angle adjusting structures 221 and second angle adjusting structures 222 are arranged in the reflecting mirror mounting groove 22. The first angle adjusting structures 221 and the second angle adjusting structures 222 are configured to adjust the inclination angle of the reflecting mirror 7. The first angle adjusting structures 221 and the second angle adjusting structures 222 are separately arranged on two ends of the reflecting mirror mounting groove 22. The inclination angle of the reflecting mirror 7 is adjusted by adjusting a height difference and a distance ratio between the first angle adjusting structures 221 and the second angle adjusting structures 222, Second mounting posts 224 are arranged on a first end of the reflecting mirror mounting groove 22. Limiting structures 223 are arranged on the second end of the reflecting mirror mounting groove 22. A second threaded hole is on one end of each of the second mounting posts 224 away from the mounting frame 2. The limiting structures 223 are arranged on one side away from the mounting frame 2. During installation, the reflecting mirror 7 is clamped into the reflecting mirror mounting groove 22, the limiting structures 223 limit a longitudinal movement of one end of the reflecting mirror 7. Screws are screwed into the second threaded holes and tightened to limit a longitudinal movement of another end of the reflecting mirror 7. A groove body of the reflecting mirror mounting groove 22 limits a horizontal movement of the reflecting mirror 7. Thus, the reflecting mirror 7 is fixed and finally to realize the fixing and an adjustment of the inclination angle of the reflecting mirror 7.

The projection device further comprises an interference structure 3 configured to generate a pattern effect. The interference structure 3 is arranged on a reflecting light path of the reflecting mirror 7. The interference structure 3 is configured to generate interference. In order to realize a rotation of the interference structure 3, a first gear structure 4 is provided. The first gear structure 4 is arranged on an outer side of the interference structure 3. In the embodiment of the present disclosure, the interference structure 3 comprises a first circular glass slide and a second circular glass slide, and the interference structure 3 is configured to generate interference. The specific structure of the interference structure does not limit the protection scope of the present disclosure. In order to place the interference structure 3, a through hole structure is provided on the mounting frame 2, and a limiting plate structure is arranged on an inner side of the through hole structure. A circular hole is enclosed by the limiting plate structure and the circular hole is configured to limit a range of the light path.

Hook structures are arranged on the through hole structure. The hook structures are on one side of the limiting plate structure. A first circular glass slide is positioned in the through hole structure through the hook structures and the limiting plate structure. The first circular slide receives reflected light of the reflecting mirror 7. On the other side of the limiting plate structure, the first gear structure 4 is embedded in the through hole structure. The second circular glass slide is embedded in a central circular axis of the first gear structure 4. The interference structure 3 is fixed through the above structures.

In order to limit a longitudinal movement of the second circular glass slide arranged in the first gear structure 4, a gear pressing sheet 5 is provided. A first end of the gear pressing sheet 5 is fixed to the first gear structure 4 by a screw, and a second end of the gear pressing sheet 5 is clamped in the second circular glass slide to limit the longitudinal movement of the second circular glass slide. In order to limit the longitudinal movement of the first gear structure 4, a gear cover 6 is provided. The gear cover 6 is sleeved on an outer side of the first gear structure 4 and is fixed to the mounting frame 2 by screws. An opening is defined on the gear cover 6. The opening exposes gear teeth of the first gear structure 4. The mounting of the first gear structure 4 and second circular glass slide embedded in the first gear structure 4 is realized by arrangement of the gear pressing sheet 5 and the gear cover 6.

The projection device further comprises a convex lens 16. The convex lens 16 is arranged on an exit light path of the interference structure 3. The first light beam reflects to a side surface of the interference structure 3 after irradiating on the one surface of the reflecting mirror 7. The first light beam passes through the interference structure 3 and the convex lens 16 in sequence to form a patterned projection The mechanism of patterned projection is an interference of light, which is the prior art. Therefore, it will not be described in detail herein. In the embodiment of the present disclosure, the convex lens 16 is embedded in the pattern projection window 131, and a lens pressing sheet 15 is provided to fix the convex lens 16.

In order to realize a movement of the patterned projection, the projection device further comprises a motor 8. A second gear structure 9 engaged with the first gear structure 4 is arranged on an output shaft of the motor 8. The first gear structure 4 and the second gear structure 9 rotate to make the interference structure 3 to rotate.

The first gear structure 4 and the second gear structure 9 are arranged on the outer side of the interference structure 3. By rotating of gear teeth of the first gear structure 4 and the second gear structure 9, an effect of movement of the patterned projection is realized. Moreover, the interference structure 3 is compactly installed, so the resulting projection device has a relatively compact structure.

Furthermore, in one embodiment of the present disclosure, a central axis of the light beam generator 1 is perpendicular to a central axis of the interference structure 3. The central axis of the light beam generator 1 is 45 degrees with a normal of the reflecting mirror 7. The first light beam is totally reflected by the reflecting mirror 7 onto the interference structure 3, then the first light beam sequentially passes through the interference structure 3 and the convex lens 16 to form the patterned projection.

It should be noted that a limiting method of the interference structure 3 does not affect the protection scope of the present disclosure, and the specific choice of a structure of the interference structure 3 does not limit the protection scope of the present disclosure. In other embodiments, the interference structure 3 is an interference sheet.

In order to obtain light spots similar to stars, a coherent light source assembly 17 is provided on the mounting frame 2. The coherent light source assembly 17 is selected from a laser, a laser diode, etc. The coherent light source assembly 17 provides a coherent light source. The projection device further comprises a grating sheet 11. The grating sheet 11 is arranged on an exit light path of the coherent light source assembly. A second light beam emitted by the coherent light source assembly 17 passes through the grating sheet 11 to form light spots similar to the stars. In the embodiment of the present disclosure, the grating sheet 11 is clamped on one side of the star projection window 132 close to the mounting frame 2. In order to prevent dust from polluting the grating sheet 11, a dust-proof structure 14 is arranged in the star projection window 132. The dust-proof structure 14 is close to the outer side of the housing 13.

In the embodiment of the present disclosure, the projection device further comprises a heat dissipating device 10. The heat dissipating device 10 is sleeved on an outside of the coherent light source assembly. In the embodiment of the present disclosure, the projection device further comprise a circuit board 12. The heat dissipating device 10 is fixed by the second fastening structure 24 arranged on the mounting frame 2. The circuit board 12 is clamped on one side of the mounting frame 2, and the circuit board 12 is fixed by the third fastening structure 133 arranged on an inner side of the housing 13. The mounting frame 2 and the housing 13 are fixed by screws.

The above are optional embodiments of the present disclosure, and do not limit the scope of the present disclosure. Any equivalent structural transformation made by using the content of the specification and drawings under the inventive concept of the present disclosure, or technical solutions directly/indirectly applied in other related technical fields are included in the protection scope of the present disclosure.

What is claimed is:

1. A projection device, comprising:

a light beam generator;

a reflecting mirror arranged on one side of the light beam generator;

an interference structure configured to generate a pattern effect;

a first gear structure arranged on an outer side of the interference structure;

a convex lens arranged on an exit light path of the interference structure; and a motor;

wherein the light beam generator comprises an incoherent light source assembly; a first light beam generated by the light beam generator irradiates on a surface of the reflecting mirror along an incident light path of the reflecting mirror; the interference structure is arranged on a reflecting light path of the reflecting mirror; the first light beam reflects to a side surface of the interference structure after irradiating on the surface of the reflecting mirror; the first light beam passes through the interference structure and the convex lens in sequence to form a patterned projection; a second gear structure engaged with the first gear structure is arranged on an output shaft of the motor; the first gear structure and the second gear structure rotate to make the interference structure to rotate.

2. The projection device according to claim 1, wherein the projection device further comprises a coherent light source assembly and a grating sheet; the coherent light source assembly provides a coherent light source; the grating sheet is arranged on an exit light path of the coherent light source assembly; a second light beam emitted by the coherent light source assembly passes through the grating sheet to form light spots; the light spots are star-shaped.

3. The projection device according to claim 1, wherein the light beam generator further comprises a condenser cup; light emitted by the incoherent light source assembly passes through the condenser cup to form the first light beam of the light beam generator.

4. The projection device according to claim 1, wherein a central axis of the light beam generator is perpendicular to a central axis of the interference structure; the central axis of the light beam generator is 45 degrees with a normal of the reflecting mirror, the first light beam is totally reflected by the reflecting mirror onto the interference structure, then the first light beam sequentially passes through the interference structure and the convex lens to form the patterned projection.

* * * * *